US009115724B2

(12) United States Patent
Chen et al.

(10) Patent No.: US 9,115,724 B2
(45) Date of Patent: Aug. 25, 2015

(54) BLADE STRUCTURE AND CEILING FAN HAVING THE SAME

(71) Applicant: PAN AIR ELECTRIC CO., LTD., Taichung (TW)

(72) Inventors: Chui-Yuan Chen, Taichung (TW); Yi-Hsin Liu, Taichung (TW)

(73) Assignee: PAN AIR ELECTRIC CO., LTD., Taichung (TW)

( * ) Notice: Subject to any disclaimer, the term of this patent is extended or adjusted under 35 U.S.C. 154(b) by 490 days.

(21) Appl. No.: 13/654,202

(22) Filed: Oct. 17, 2012

(65) Prior Publication Data

US 2013/0101427 A1 Apr. 25, 2013

(30) Foreign Application Priority Data

Oct. 21, 2011 (TW) ..... 100138252

(51) Int. Cl.
*F04D 29/38* (2006.01)
*F04D 25/08* (2006.01)

(52) U.S. Cl.
CPC ..... *F04D 25/088* (2013.01); *F04D 29/382* (2013.01); *F04D 29/384* (2013.01)

(58) Field of Classification Search
CPC ... F04D 25/088; F04D 29/324; F04D 29/325; F04D 29/38; F04D 29/382; F04D 29/384
USPC ..... 416/227 A, 241 R
See application file for complete search history.

(56) References Cited

U.S. PATENT DOCUMENTS

| | | | | |
|---|---|---|---|---|
| 680,671 | A * | 8/1901 | Brewster | 416/227 R |
| 2,552,651 | A * | 5/1951 | Skold | 416/204 R |
| 7,018,167 | B2 * | 3/2006 | Yoshida | 415/4.5 |
| D630,724 | S * | 1/2011 | Liu | D23/413 |

FOREIGN PATENT DOCUMENTS

| | | |
|---|---|---|
| TW | D139690 | 3/2011 |

* cited by examiner

*Primary Examiner* — Ninh H Nguyen
(74) *Attorney, Agent, or Firm* — Muncy, Geissler, Olds & Lowe, P.C.

(57) ABSTRACT

A blade structure and ceiling fan having the same are disclosed. The blade structure includes a blade root, a blade tip, and a first vertex and a second vertex between the blade root and the blade tip. The blade bends from blade root to the first vertex, the blade tip and then bends from the blade tip to the second vertex and back to the blade root to form a hollow structure. The ceiling fan with the blade structure not only provides air modulating function but also has unique modeling.

17 Claims, 5 Drawing Sheets

BLADE STRUCTURE AND CEILING FAN HAVING THE SAME

CROSS-REFERENCE TO RELATED APPLICATION

This application claims the benefit of Taiwan Patent Application No. 100138252, filed on Oct. 21, 2011, in the Taiwan Intellectual Property Office, the disclosure of which is incorporated herein in its entirety by reference.

BACKGROUND OF THE INVENTION

1. Field of the Invention

The present invention relates to a ceiling fan and its blade structure, and more particularly to a blade structure and a ceiling fan having the same that have a hollow structure with different bending radians to simultaneously satisfy airstream control and unique appearance.

2. Description of the Related Art

In modern living, ceiling fans have become popular auxiliary devices for producing airflow in business and household buildings due to the feature of large air blowing area that effectively controls airflow and temperature.

In the structures of the ceiling fans and the blades, however, are necessary components. If the structure of the blades is not well designed, the rotational speed and airflow of the ceiling fan may be affected, noise may be generated during the rotation process, and the stability of the operation of the ceiling fan may be influenced owing to the undue air resistance caused by the blades. The ceiling fans in the buildings, in addition to providing major ventilation functions, should also provide stylist accent per consumers' demand. Therefore, a beautiful design with low air resistance, high rotational speed, and low noise has become an important subject matter in ceiling fan development and application, and is the major difficult task that needs to be overcome by ceiling fan manufacturers.

The ceiling fan blade of Taiwan design patent number D139690, for example, does not take into account the air resistance, appropriate airflow, stability and reasonable noise threshold value; thus not applicable to merchantable products. The present invention provides a reasonable and practicable scheme contemplating shape, airflow, stability, noise values and other various empirical desires.

SUMMARY OF THE INVENTION

In view of the shortcomings of the prior art, the inventor(s) of the present invention based on years of experience in the related industry to conduct extensive researches and experiments, and finally developed a blade structure and a ceiling fan having the blade structure as a principle objective to simultaneously provide blades having different bending radians and a hollow structure at a horizontal direction and a vertical direction. It does not only achieve features of low wind resistance, high rotational speed, low noise but also has beauty and modeling to greatly improve the overall performance and visual sense.

The invention provides a blade structure comprising a blade root at one end, a blade tip located at the other end, and a first vertex and a second vertex located between the blade root and the blade tip, wherein the blade is bent from the blade root to the first vertex, and further to the blade tip, and the blade is bent from the blade tip to the second vertex, and further to the blade root so as to form a hollow structure. At a first side of a first axis, a first node and a second node are located between the blade root and the first vertex. A maximum slope of the blade to a first axis occurs at the first node, and a maximum horizontal included angle between the blade and a second axis which is perpendicular to the first axis occurs at the second node. A ceiling fan capable of containing air regulation and beauty modeling can be achieved through the foregoing blade structures.

The invention further provides a ceiling fan having a main body, a plurality of blades and a main body lower case. The main body is for providing a rotation power. The plurality of blades is mounted to the main body through the main body lower case. The ceiling fan is characterized in that a blade of the plurality of blades comprising the blade root at one end, a blade tip located at the other end, and a first vertex and a second vertex located between the blade root and the blade tip, wherein the blade is bent from the blade root to the first vertex, and further to the blade tip, and the blade is bent from the blade tip to the second vertex, and further to the blade root so as to form a hollow structure. At a first side of a first axis, a first node and a second node are located between the blade root and the first vertex, wherein a maximum slope of the blade to the first axis occurs at the first node and a maximum horizontal included angle between the blade and a second axis which is perpendicular to the first axis occurs at the second node.

BRIEF DESCRIPTION OF THE DRAWINGS

The detailed structure, operating principle and effects of the present invention will now be described in more details hereinafter with reference to the accompanying drawings that show various embodiments of the invention as follows.

DETAILED DESCRIPTION OF THE PREFERRED EMBODIMENTS

The foregoing and other technical characteristics of the present invention will become apparent with the detailed description of the preferred embodiments and the illustration of the related drawings.

Figure 1:
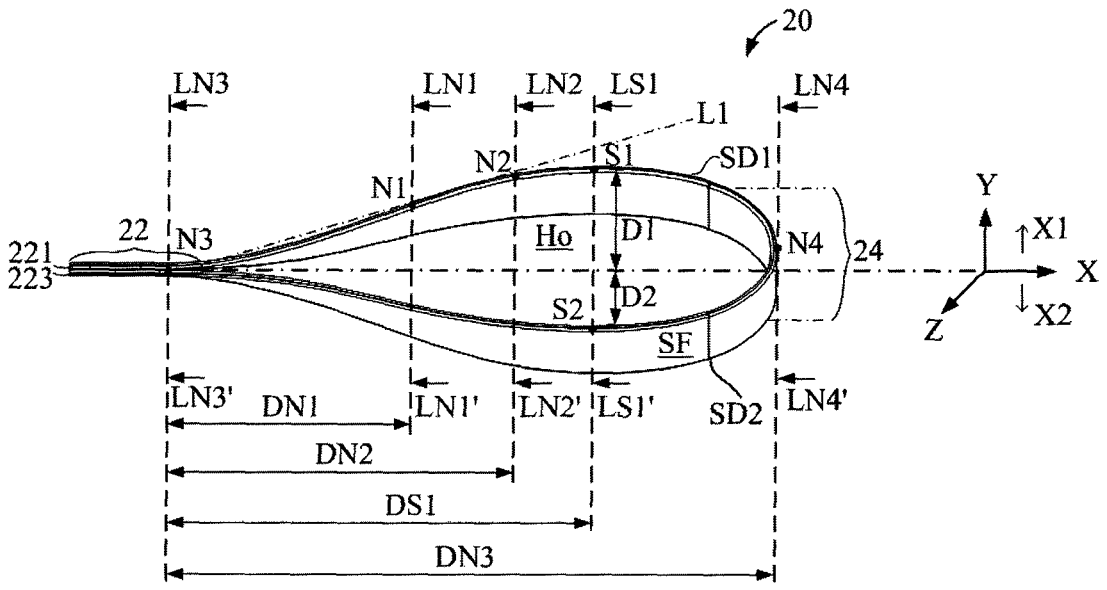
FIG. 1 is a schematic diagram of a blade structure according to an embodiment of the invention.
Figure 2:
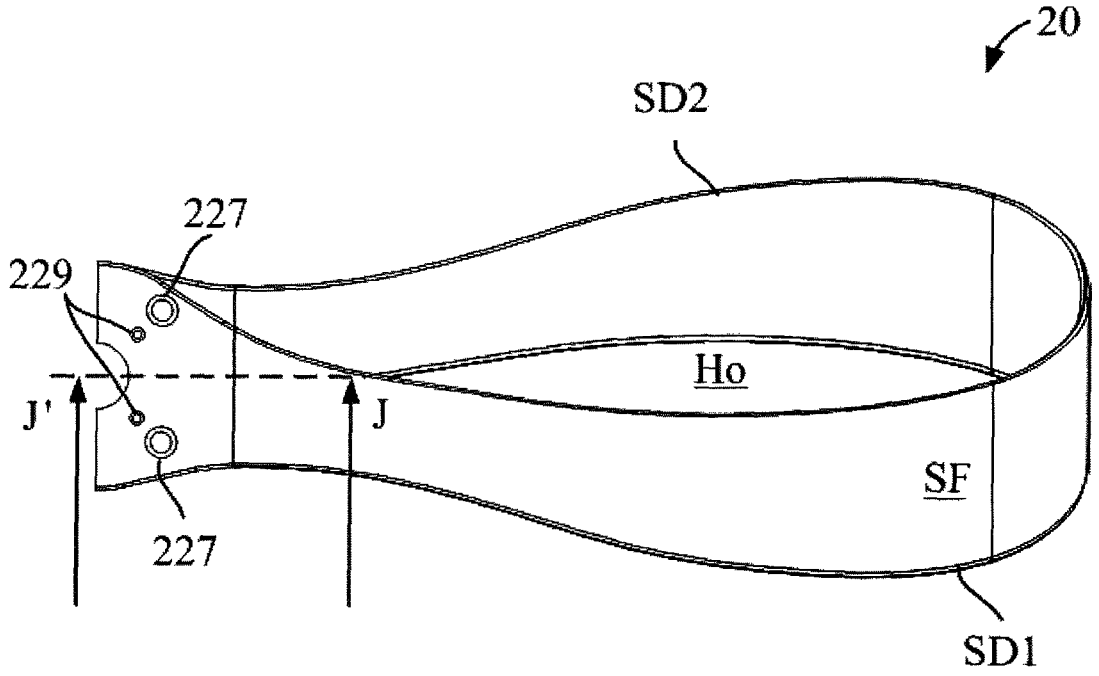
FIG. 2 is a top view of a blade structure according to an embodiment of the invention.

With reference to FIG. 1 for a schematic diagram of a blade structure according to an embodiment of the invention is depicted. FIG. 2 is a top view of a blade structure according to an embodiment of the invention. As shown in FIG. 1 and FIG. 2, the invention provides a blade structure comprising a blade root 22 at one end, a blade tip 24 located at the other end, and a first vertex S1 and a second vertex S2 located between the blade root 22 and the blade tip 24. The blade 20 is bent from the blade root 22 to the first vertex 51, then to the blade tip 24, and bent further from the blade tip 24 to the second vertex S2, then back to the blade root 22 to form a hollow structure Ho. The material of the blade 20 of the invention can, but not limited to, be polycarbonate (PC), plastic bent wood, metal panel, acrylonitrile butadiene styrene (ABS) or acrylonitrile styrene (AS).

The blade 20 has a first side edge SD1 and a second side edge SD2. The first vertex S1 and the second vertex S2 are located at the first side edge SD1 of the blade 20 and are respectively located at a first side (as shown in an arrow X1) and a second side (as shown in an arrow X2) of a first axis X horizontally extended from the blade root 22. Distance D1 between the first vertex S1 and the first axis X is the maximum distance between the first axis X and the first side edge SD1 in the first side X1 of the first axis X. Distance D2 between the second vertex S2 and the first axis X is the maximum distance between the first axis X and the first side edge SD1 in the second side X2 of the first axis X.

Figure 3:
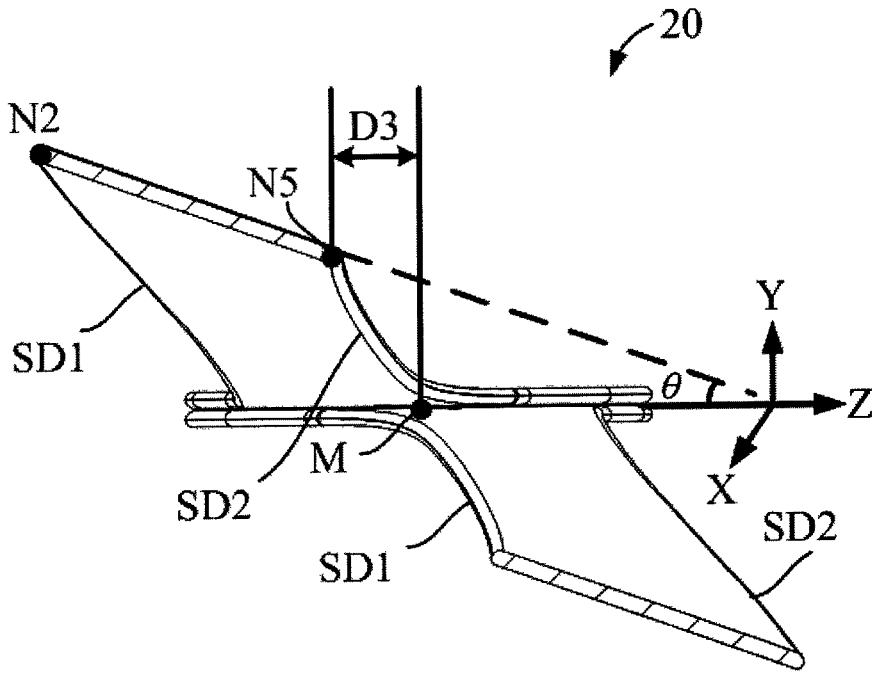
FIG. 3 is a cross-sectional drawing of a blade structure taken along a section (LN2-LN2') of FIG. 1.

With reference to FIG. 1 to FIG. 3, FIG. 3 is a cross-sectional drawing of a blade structure taken along a section (LN2-LN2') of FIG. 1. As shown in FIG. 1 to FIG. 3, three coordinate axes of X, Y, and Z at a three-dimensional space are firstly defined as follows: X coordinate axis is the first axis X depicted in the invention, and Z coordinate axis is a second axis Z depicted in the invention, and Y coordinate axis is a third axis Y depicted in the invention. The first axis X, the second axis Z and the third axis Y are perpendicular to each other, wherein the hollow structure Ho of the blade is hollow along the third axis Y as shown in the figure.

In an embodiment, a first node N1, a second node N2 and a third node N3 are located between the first vertex S1 and the blade root 22 on the first side edge SD1 of the blade 20 at the first side X1 of the first axis X. The first node N1, the second node N2 and the third node N3 are further defined as the following. In an embodiment, the maximum slope of the blade 20 with respect to the first axis X occurs on a tangent L1 of blade 20 at the first node N1. The second node N2 is located between the first vertex S1 and the first node N1. The second node N2 of the blade 20 has the maximum horizontal included angle θ between the blade 20 and the second axis Z, wherein the horizontal included angle θ in the preferred embodiment is about 18 to 25 degrees. The third node N3 is located at a location of the blade root 22 where the horizontal included angle between the blade root 22 and the first axis X is zero. The second vertex S2 and the first vertex S1 of the blade 20 are located at the same section of the third axis Y. In addition, the blade tip 24 on the first side edge SD1 of the blade 20 further includes a fourth node N4. The fourth node N4 is located at a section (LN4-LN4') of the blade tip 24 that is perpendicular to the first axis X.

Besides the foregoing nodes N1-N4, the second side edge SD2 of the blade 20 has a fifth node N5 located on a section (LN2-LN2') taken along the third axis Y, in which the second node N2 is located. The blade 20 has a center point M taken along the second axis Z. Between the section of the fifth node N5 taken along the third axis Y and the section of the center point M taken along the third axis Y is the maximum distance D3 between the second side edge SD2 of the blade 20 and center point M in the first side X1 of the first axis X. In a preferred embodiment, the maximum horizontal included angle θ of blade 20 is an included angle between the second axis Z and the line taken along the second node N2 to the fifth node N5. The blade 20 of the blade structure according to the invention has a first surface SF between the first side edge SD1 and the second side edge SD2. The first surface SF has a maximum width at the blade tip 24, and the first surface SF of the blade 20 has a minimum width between the first node N1 and the third node N3 on the first side edge SD1.

In an embodiment, a first node N1, a second node N2 and a third node N3 are located between the first vertex S1 and the blade root 22 on the first side edge SD1 of the blade 20 at the first side X1 of the first axis X. The first node N1, the second node N2 and the third node N3 are further defined as the following. In an embodiment, the maximum slope of tangent of the blade 20 with respect to the first axis X occurs on a tangent L1 of blade 20 at the first node N1. The second node N2 is located between the first vertex S1 and the first node N1. The second node N2 of the blade 20 has the maximum horizontal included angle θ between the blade 20 and the second axis Z is formed by a line extending from the second node N2 of the blade 20 on the section (LN2-LN2') and the second axis Z, wherein the horizontal included angle θ in the preferred embodiment is about 18 to 25 degrees. The third node N3 is located at a location of the blade root 22 where the horizontal included angle between the blade root 22 and the first axis X is zero. The second vertex S2 and the first vertex S1 of the blade 20 are located at the same section of the third axis Y. In addition, the blade tip 24 on the first side edge SD1 of the blade 20 further includes a fourth node N4. The fourth node N4 is located at a section (LN4-LN4') of the blade tip 24 that is perpendicular to the first axis X.

Besides the foregoing nodes N1-N4, the second side edge SD2 of the blade 20 has a fifth node N5 located on a section (LN2-LN2') taken along the third axis Y, in which the second node N2 is located. The blade 20 has a center point M taken along the second axis Z, and the center point M is located at a crosspoint between the section (LN1-LN2') and the first axis X. Between the section of the fifth node N5 taken along the third axis Y and the section of the center point M taken along the third axis Y is the maximum distance D3 between the second side edge SD2 of the blade 20 and center point M in the first side X1 of the first axis X. In a preferred embodiment, the maximum horizontal included angle θ of blade 20 is an included angle between the second axis Z and the line taken along the second node N2 to the fifth node N5. The blade 20 of the blade structure according to the invention has a first surface SF between the first side edge SD1 and the second side edge SD2. The first surface SF has a maximum width at the blade tip 24, and the first. surface SF of the blade 20 has a minimum width between the first node N1 and the third node N3 on the first side edge SD1.

With reference to Table I, the table I illustrates the airflow, rotation speed and noise with respect to various horizontal included angle θ on the second node N2. As shown in Table I, under a condition of using the same output power, take the section (LN2-LN2') along the third axis Y as a basis where the second node N2 and the fifth node N5 are set thereon, while keeping other geometric relationship unchanged, and vary the horizontal included angle θ between the second axis Z and the line taken along the second node N2 to the fifth node N5. The table illustrates the measurement of airflow, rotational speeds, and noise of the blade 20 with respect to various horizontal included angle θ.

TABLE I

| Horizontal included angle θ | 18° | 20° | 25° |
|---|---|---|---|
| Airflow (CFM) | 4385 | 6956 | 6278 |
| Rotation speed (rpm) | 260 | 250 | 240 |
| Noise (dB) | 55 | 60 | 62 |

With experimental observation and verification, when the horizontal included angle θ is smaller than 18 degrees, the airflow is dramatically reduced. When the horizontal included angle θ is greater than 25 degrees, the rotational speed and airflow are decreased, and the vertical vibration range of the blade 20 is increased to the extent that may affect the stability of the operation of the ceiling fan. A preferred embodiment is that the horizontal included angle θ between the second axis Z and the line taken along the second node N2 to the fifth node N5 is within a range of 18 to 25 degrees.

Figure 4A:
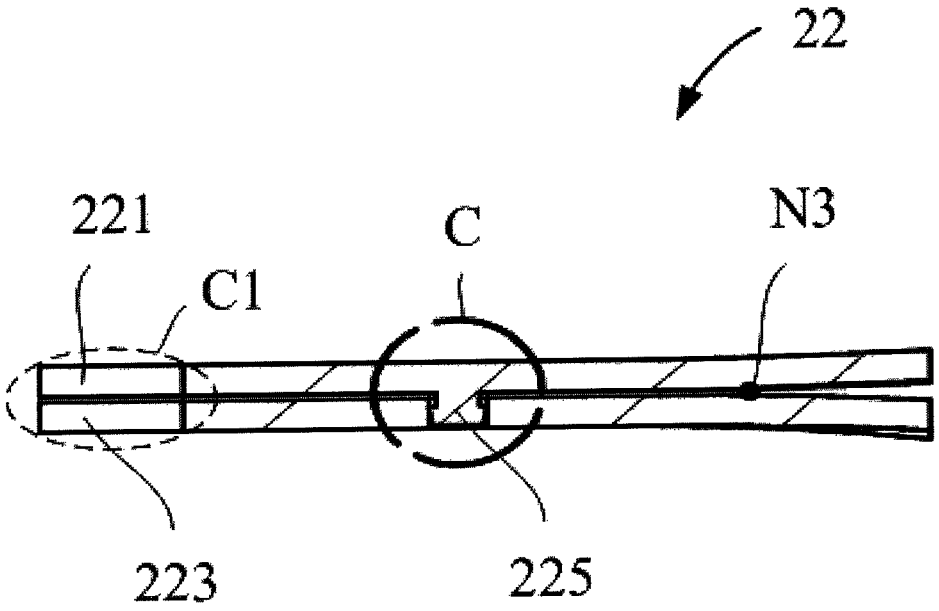
FIG. 4A is a cross-sectional drawing of a blade structure taken along a section (J-J') shown in FIG. 2.
Figure 4B:
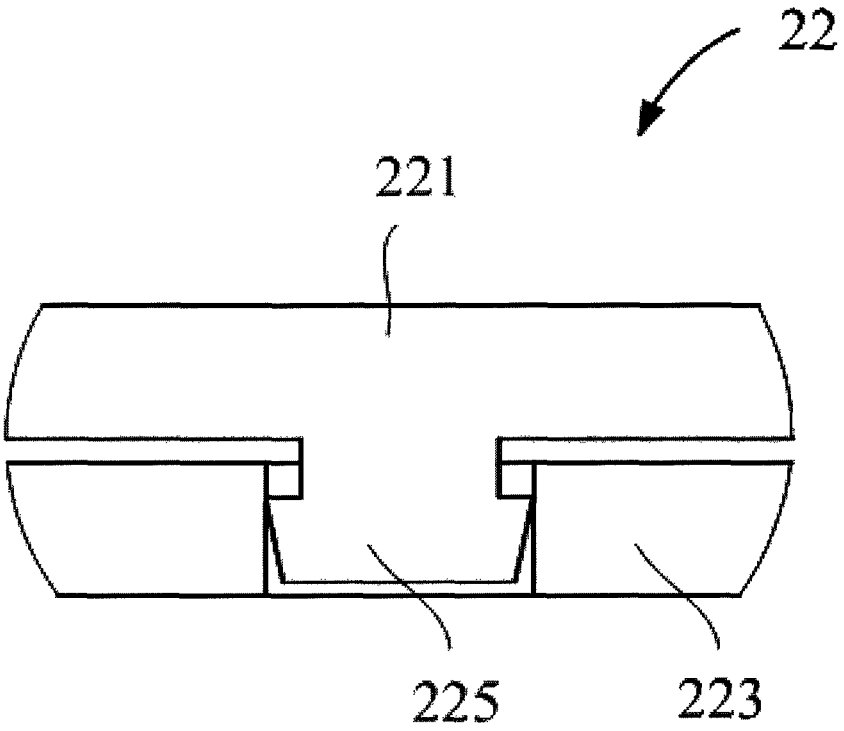
FIG. 4B is a local enlarged diagram of a circle C shown in FIG. 4A.
Figure 5:
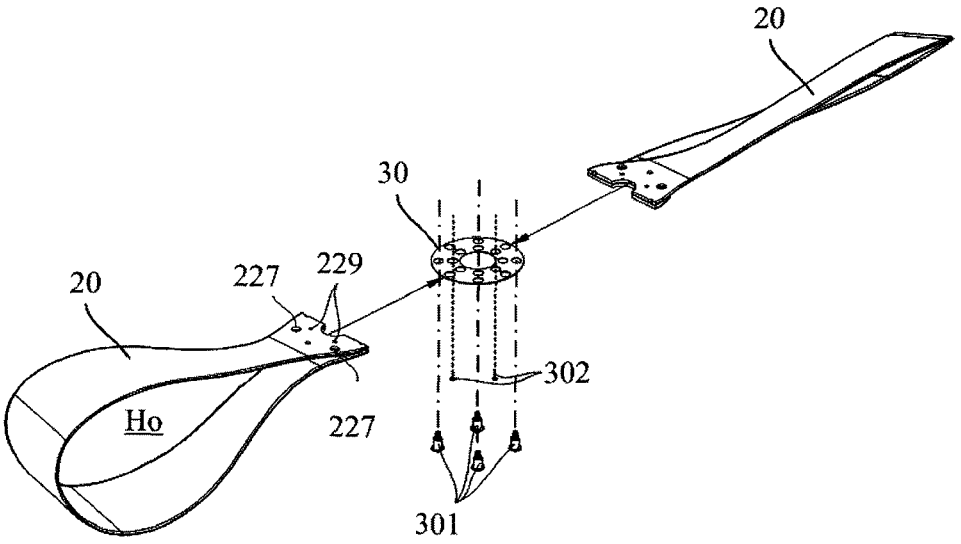
FIG. 5 is a schematic diagram of fastening portions of a blade structure shown in FIG. 2.

With reference to FIG. 4A and FIG. 4B, FIG. 4A is a cross-sectional drawing of a blade structure taken along the section (J-J') shown in FIG. 2. FIG. 4B is a local enlarged diagram of a circle C shown in FIG. 4A. In an embodiment, the blade root 22 has a first connection member 221 and a second connection member 223. The first connection member 221 is connected to the second connection member 223 through a tenon 225. In the embodiment shown in FIG. 4A and FIG. 4B, the tenon 225 is disposed on the first connection member 221 and can be disposed at the second connection member 223 in other embodiments. As long as the embodiments that allow different kinds of tenons to closely connect the first connection member 221 and the second connection member 223 can become the embodiment for the tenon 225 depicted in the blade structure of the invention. In addition, the first connection member 221 and the second connection member 223 that are distant from the blade tip 24 can be closely connected together (as shown in the circle C1 of FIG. 4A).

With reference to FIG. 2, FIG. 4A, FIG. 4B and FIG. 5, FIG. 5 is a schematic diagram of fastening portions of a blade structure shown in FIG. 2. As shown in FIG. 2, FIG. 4A, FIG. 4B and FIG. 5, the first connection member 221 and the second connection member 223 of the blade root 22 have the first fastening portion 227 and the second fastening portion 229. The first connection member 221 and the second connection member 223 of the blade 20 are fastened on a main body lower case 30 of a ceiling fan (not shown in the figure) by using a screw 301 passing through the first fastening portion 227. The second fastening portion 229 affixes the blade 20 to the main body lower case 30 by using a bolt 302. With the foregoing fastening manners, the blade 20 can be fastened on the ceiling fan (not shown in the figure) via the main body lower case 30.

In an embodiment, the first connection member 221 and the second connection member 223 of the blade root 22 can be connected via the tenon 225. Afterward, the second fastening portion 229 affixes the blade 20 to the main body lower case 30. Further, the first connection member 221 and the second connection member 223 of the blade 20 are fastened on the main body lower case 30 by using a screw 301 via the first fastening portion 227. Since the blades are a composite layer structure, the error on the installation may easily influence the stability of the operation of the ceiling fan. Therefore, the fastening procedure in accordance with the mentioned steps not only achieves easy assembly but also enhances the stability of the blade when the ceiling fan operates.

Figure 6:
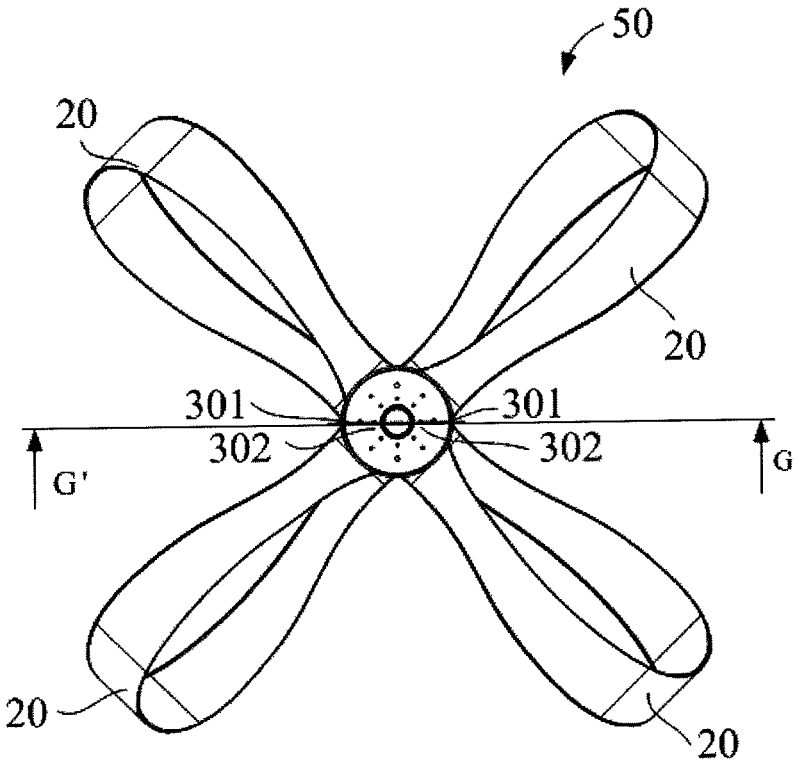
FIG. 6 is a bottom view of a ceiling fan having blade structures according to an embodiment of the invention.
Figure 7A:
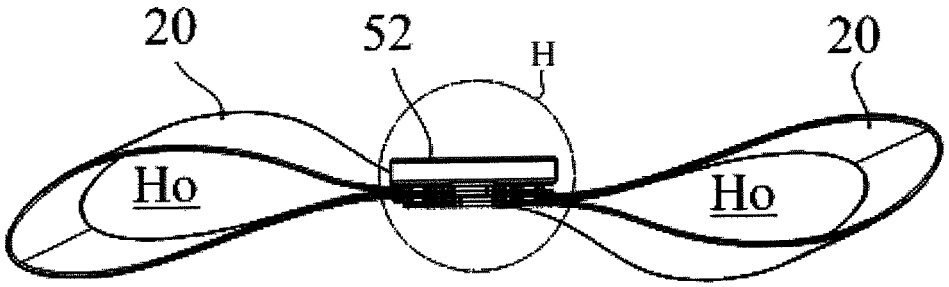
FIG. 7A is a cross-sectional drawing taken along a section (G-G') shown in FIG. 6.
Figure 7B:
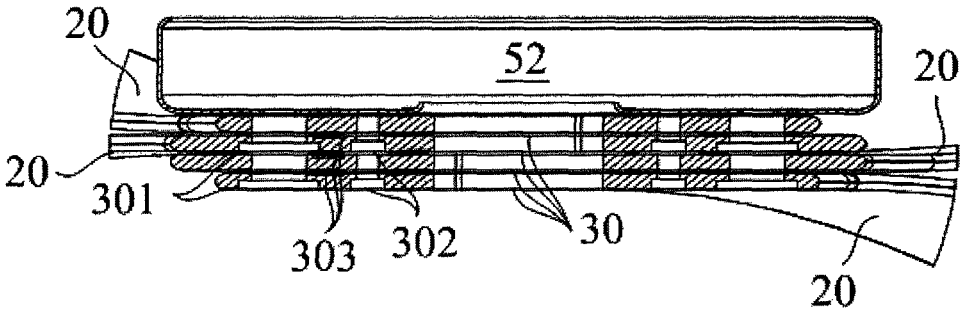
FIG. 7B is a local enlarged diagram of a circle H shown in FIG. 7A.

With reference to FIG. 6, FIG. 7A and FIG. 7B, FIG. 6 is a bottom view of a ceiling fan having blade structures according to an embodiment of the invention. FIG. 7A is a cross-sectional drawing taken along a section (G-G') shown in FIG. 6. FIG. 7B is a local enlarged diagram of a circle H shown in FIG. 7A. In the embodiment shown in FIG. 6, the ceiling fan 50 has four blades 20. The four blades 20 are fastened on a main body 52 of the ceiling fan 50 via the main body lower case 30, the screw 301 and the bolt 302, wherein the structure of the blade 20 is depicted in the foregoing embodiments, and there is no need to describe herein. The main body 52 of the ceiling fan 50 is utilized for providing a rotating power. The blade 20 is driven by the rotating power to perform rotation to achieve the effect of modulating airstream. At least one gasket 303 is disposed between the blades 20. Further, at least one gasket 303 is also disposed between the first connection member 221 and the second connection member 223 in the blade 20. The gasket 303 can be used for preventing noise or wear caused by the friction between the first connection member 221 and the second connection member 223 or the friction between the blade 20.

The blade structure of the invention is to produce a specific hollow structure having various bending radians both at the horizontal direction and the vertical direction between the blade root and the blade tip. With calculations and experiments, the location and angle of the nodes on the blade may have the optimum standard. In addition, soft gaskets are respectively disposed between the blades and between connection members of the blade to reduce noise or abrasion caused by the friction between different connection members of the blade or different blades, wherein the friction was caused by the dynamic deformation of the blades. Not only does the blade structure of the invention increase the airflow of the ceiling fan, reduces noise, and improves the stability, but also provide the added value of unique and stylist appearance.

The invention improves over the prior art and complies with patent application requirements, and thus is duly filed for patent application. While the invention has been described by device of specific embodiments, numerous modifications and variations could be made thereto by those generally skilled in the art without departing from the scope and spirit of the invention set forth in the claims.

What is claimed is:

1. A blade structure having a blade comprising:

a blade root at one end;

a blade tip located at the other end;

a first vertex and a second vertex located between the blade root and the blade tip, wherein the blade is bent from the blade root to the first vertex, the blade tip, the second vertex, and to the blade root in sequence so as to form a hollow structure; and a first node and a second node between the blade root and the first vertex, wherein a maximum slope of a tangent of the blade to a first axis occurs at the first node and a maximum horizontal included angle between the blade and a second axis which is perpendicular to the first axis is formed by a line extending from the second node of the blades on a section taken along a third axis in which the second node is located thereon and the second axis;

wherein the first vertex and the second vertex are located at a first side edge of the blade and respectively located at a first side and a second side of the first axis horizontally extended from the blade root, and a distance between the first vertex and the first axis is a maximum distance between the first axis and the first side edge in the first side of the first axis, and a distance between the second vertex and the first axis is a maximum distance between the first axis and the first side edge in the second side of the first axis;

wherein a second side edge of the blade has a fifth node located on the section taken along the third axis in which the second node is located, and a maximum horizontal distance is between a section of the blade where the fifth node is set thereon along the third axis and a section of the blade where a central point is set thereon along the second axis at the third axis, and wherein the central point is located at a crosspoint between the section taken along the third axis in which the second node is located and the first axis, wherein the third axis is perpendicular to the first axis and the second axis, and the second side edge is located at another side of the first side edge of the blade along the second axis;

wherein a horizontal included angle between the second node to the fifth on the blade and the second axis is 18 to 25 degrees.

2. The blade structure as recited in claim 1, wherein the blade further comprises a third node and a fourth node, and the third node is located at a location of the blade root where a horizontal included angle between the blade root and the first axis is zero, and the fourth node is located at a tangent line of the blade tip that is perpendicular to the first axis.

3. The blade structure as recited in claim 2, wherein a horizontal distance between a section of the blade where the first node is set thereon along a third axis and a section where the third node is set thereon along the third axis is 0.38 to 0.42 times to a horizontal distance between the section where the third node is set thereon along the third axis and a section of the blade tip where the fourth node is set thereon along the third axis, wherein the third axis is perpendicular to the first axis and the second axis.

4. The blade structure as recited in claim 2, wherein a horizontal distance between a section of the blade where the second node is set thereon along the third axis and the section where the third node is set thereon along the third axis is 0.55 to 0.59 times to a horizontal distance between the section where the third node is set thereon along the third axis and a section of the blade tip where the fourth node is set thereon along the third axis, wherein the third axis is perpendicular to the first axis and the second axis.

5. The blade structure as recited in claim 2, wherein a horizontal distance between a section of the blade where the first vertex is set thereon along the third axis and a section where the third node is set thereon along the third axis is 0.7 to 0.75 times to the horizontal distance between the section where the third node is set thereon along the third axis and the section of the blade tip where the fourth node is set thereon along the third axis, wherein the third axis is perpendicular to the first axis and the second axis.

6. The blade structure as recited in claim 1, wherein the blade root has a first connection member and a second connection member, and the first connection member is connected to the second connection member via a tenon.

7. The blade structure as recited in claim 6, wherein the first connection member and the second connection member of the blade root have a first fastening portion and a second fastening portion, and the blade is fastened on a main body lower case contained by a ceiling fan by using a screw passing through the first fastening portion, and the second fastening portion affixes the blade to the main body lower case by using a bolt.

8. The blade structure as recited in claim 6, wherein at least one gasket is disposed between the first connection member and the second connection member of the blade.

9. The blade structure as recited in claim 6, wherein sides of the first connection member and the second connection member that are distant from the blade tip are connected to each other.

10. A ceiling fan having a main body, a plurality of blades and a main body lower case, and the main body for providing a rotation power, the plurality of blades mounted to the main body through the main body lower case, the ceiling fan characterized in that each blade of the plurality of blades comprising:

a blade root at one end;

a blade tip located at the other end;

a first vertex and a second vertex located between the blade root and the blade tip, wherein the blade is bent from the blade root to the first vertex, the blade tip, the second vertex, and to the blade root in sequence so as to form a hollow structure; and a first node and a second node located between the blade root and the first vertex, wherein a maximum slope of a tangent of the blade to a first axis occurs at the first node and a maximum horizontal included angle between the blade and a second axis which is perpendicular to the first axis is formed by a line extending from the second node of the blades on a section taken along a third axis in which the second node is located thereon and the second axis;

wherein the first vertex and the second vertex are located at a first side edge of the blade and respectively located at a first side and a second side of the first axis horizontally extended from the blade root, and a distance between the first vertex and the first axis is a maximum distance between the first axis and the first side edge in the first side of the first axis, and a distance between the second vertex and the first axis is a maximum distance between the first axis and the first side edge in the second side of the first axis;

wherein a second side edge of the blade has a fifth node located on the section taken along the third axis in which the second node is located thereon, and a maximum horizontal distance is between a section of the blade where the fifth node is set thereon along the third axis and a section of the blade where a central point is set thereon along the second axis at the third axis and wherein the central point is located at a crosspoint between the section taken along the third axis in which the second node is located and the first axis, wherein the third axis is perpendicular to the first axis and the second axis, and the second side edge is located at another side of the first side edge of the blade along the second axis;

wherein a horizontal included angle between the second node to the fifth node on the blade and the second axis is 18 to 25 degrees.

11. The ceiling fan as recited in claim 10, wherein the blade further comprises a third node and a fourth node, and the third node is at a location of the blade root where the horizontal included angle between the blade root and the first axis is zero, and the fourth node is located at a tangent line of the blade tip that is perpendicular to the first axis.

12. The ceiling fan as recited in claim 11, wherein a horizontal distance between a section of the blade where the first node is set thereon along a third axis and a section where the third node is set thereon along the third axis is 0.38 to 0.42 times to a horizontal distance between the section where the third node is set thereon along the third axis and a section of the blade tip where the fourth node is set thereon along the third axis, wherein the third axis is perpendicular to the first axis and the second axis.

13. The ceiling fan as recited in claim 11, wherein a horizontal distance between a section of the blade where the second node is set thereon along the third axis and the section where the third node is set thereon along the third axis is 0.55 to 0.59 times to a horizontal distance between the section where the third node is set thereon along the third axis and a section of the blade tip where the fourth node is set thereon along the third axis, wherein the third axis is perpendicular to the first axis and the second axis.

14. The ceiling fan as recited in claim 11, wherein a horizontal distance between a section of the blade where the first vertex is set thereon along the third axis and a section where the third node is set thereon along the third axis is 0.7 to 0.75 times to the horizontal distance between the section where the third node is set thereon along the third axis and the section of the blade tip where the fourth node is set thereon along the third axis, wherein the third axis is perpendicular to the first axis and the second axis.

15. The ceiling fan as recited in claim 10, wherein the blade root has a first connection member and a second connection member, and the first connection member is connected to the second connection member via a tenon.

16. The ceiling fan as recited in claim 15, wherein the first connection member and the second connection member of the blade root have a first fastening portion and a second fastening portion, and the blade is fastened on a main body lower case contained by a ceiling fan by using a screw passing through the first fastening portion, and the second fastening portion affixes the blade to the main body lower case by using a bolt.

17. The ceiling fan as recited in claim 15, wherein at least one gasket is disposed between the first connection member and the second connection member of the blade, and sides of the first connection member and the second connection member that are distant from the blade tip are connected to each other.

* * * * *